US008360434B2

(12) United States Patent
Smith et al.

(10) Patent No.: US 8,360,434 B2
(45) Date of Patent: Jan. 29, 2013

(54) BLACKJACK-TYPE GAME WITH MODIFIED DECK

(76) Inventors: Ray Smith, Linden, NJ (US); Amanda Tears Smith, Linden, NJ (US)

( * ) Notice: Subject to any disclaimer, the term of this patent is extended or adjusted under 35 U.S.C. 154(b) by 485 days.

(21) Appl. No.: 12/589,165

(22) Filed: Oct. 19, 2009

(65) Prior Publication Data

US 2011/0089636 A1 Apr. 21, 2011

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 4,659,083 A * 4/1987 Szczepanski ..... 473/252
5,529,309 A * 6/1996 Bartlett ..... 273/292
5,615,888 A * 4/1997 Lofink et al. ..... 273/292
5,944,314 A * 8/1999 Stavinsky ..... 273/292
6,053,813 A * 4/2000 Mathis ..... 463/26
6,446,973 B1 * 9/2002 Pham ..... 273/306
6,511,071 B1 * 1/2003 Artle et al. ..... 273/292
6,637,748 B1 * 10/2003 Yuan ..... 273/292
6,688,598 B1 * 2/2004 Hsi ..... 273/292
6,742,781 B1 * 6/2004 Bartlett ..... 273/292
6,776,416 B1 * 8/2004 Jackson ..... 273/292
7,080,839 B2 7/2006 Shackleford
7,329,177 B1 * 2/2008 Hui ..... 463/11
7,942,734 B2 * 5/2011 Alderucci et al. ..... 463/21

* cited by examiner

*Primary Examiner* — Kurt Fernstrom
*Assistant Examiner* — Dolores Collins
(74) *Attorney, Agent, or Firm* — Mark A. Litman & Associates, P.A.

(57) ABSTRACT

A wagering game of at least one player hand against a dealer hand with playing card symbols is played using blackjack rule of play. At least one player makes a first wager on an underlying playing card symbol game from a set of playing card symbols. The set of playing card symbols has one of more sets of card symbols with each set having exactly thirty-six cards of count values between 1 and 9 and only twelve cards of count values of ten, suits among all cards are evenly distributed. The player is dealt exactly an initial 2-card hand. The dealer being dealt exactly an initial 2-card hand, only one dealer card dealt face-up. The player is always paid on the first wager for at least one of a number of specific payout events.

4 Claims, No Drawings

BLACKJACK-TYPE GAME WITH MODIFIED DECK

BACKGROUND OF THE INVENTION

1. Field of the Invention

The present technology relates to casino table and electronic video wagering games based on playing cards, particularly casino games based on blackjack, and most particularly casino table card games that may have a modified deck of playing cards.

2. Background of the Art

Blackjack or Twenty-One is a card game that is played on a live casino gaming table, on a video table, on-line through casino/gaming network connections and on a video gaming machine. The most popular method of play is with a live dealer and a number of players (usually up to a maximum of seven because of physical limitations on table size) at a table. Where there are seven player stations, each of the stations or positions is equally spaced around the tabletop. The dealer is positioned at one side of the table and players are positioned at an opposite, arcuate, semicircle or curved edge of the table, which is approximately semicircular in its most common form. A wagering area for placement of wagers and for receiving cards is provided at each player position, usually in the form of a printed circle identifying where wagers or cards are to be placed. To begin play of the games of Blackjack or Twenty-One, the dealer is provided with one or more (typically 1, 2, 6 or 8 decks) shuffled decks of cards. These decks may now be continuously shuffled to provide an unlimited supply of cards. These may be standard playing card decks, or modified decks according to the rules of particular games. A player places money or chips to identify the size of a wager to enter the game. Upon placement of a wager by players, the dealer provides each player that has made a wager with two initial cards. These cards may be provided with both cards face down, one card face down and another face-up, or with both cards face-up. The degree of display of a player's hand (in a casino version of the game where players compete with a dealer) has no consequence or influence on the play or outcome of the game. This is the player's preliminary hand. At or about the same time, the dealer is also provided with two cards (with one card shown face-up).

The player evaluates the player's initial hand, and where a dealer's card is displayed, against the partially revealed dealer's hand. The player then evaluates how the player's hand will be played and how wagering will continue based on the assessment.

In the play of Blackjack or Twenty-One, one or more standard decks of cards typically are used. An ace dealt to a player has a point value of either "1" or "11" at the election of the player; a face card (jack, queen or king) has a point value of "10" and each of the remaining cards ("2" through "10") have a point value equal to what is alternatively referred to as the numerical face value or number value of the card. Point values of cards held by the player are added together to obtain a player total point value. The suits of cards in a standard blackjack game have no special value and are not used in scoring hands. A dealer total point value is obtained in a similar manner, with an ace required to be a count of eleven when the player's count on a hand would be 17, 18, 19, 20 or 21.

After the wagers are placed within the imprinted circle, the player and the dealer are each dealt a hand comprised of two cards from the same shuffled deck(s). The cards of the player's hand are dealt face-up, partially revealed or face-down. A first (not necessarily first in order of dealing) card of the player's hand is dealt face-down. A second one of the player's hand is dealt face-up.

Whenever the player's face-up card is either an ace or has a point value of "10", the dealer ascertains the point value of the face-down card without revealing it to the player unless the dealer total point value is "21". When the first two cards of the dealer hand cause the dealer total point value to be "21", the dealer is said to have blackjack whereupon the dealer turns the face-down card face up. Under the circumstance of the dealer having a blackjack, the dealer wins against all players, except those who also have a blackjack, where a push or tie is declared. Similarly, when the two cards of the player hand causes the player total point value to be "21", the player is said to have blackjack, and that player immediately wins against the dealer, unless the dealer also has a two-card hand point count of 21, another blackjack.

When the dealer has blackjack, the dealer wins the wager with two exceptions. A first exception occurs when the dealer's face up card is an ace and the player places a separate and additional wager (up to a maximum of one-half the amount of the initial game wafer) representing an insurance bet. When the dealer does not have blackjack, the player loses the insurance bet. When the dealer has blackjack, the insurance wager is paid off to the player as 2:1 and the insurance bet is returned to the player.

The second exception to the dealer winning with a blackjack occurs when the player also has blackjack. In that case, the player's wager is a push, and is returned to the player. The second exception is just one example of when the player hand and the dealer hand have the same total point value and is referred to as a push or tie.

When the player has a blackjack and the dealer does not, the player wins the wager. When neither the dealer nor the player has blackjack, the player then has four options. A first option is to have the count of the player's hand augmented by at least one additional card (referred to as a "hit"). The player may elect to have successive hits until the player total point value reaches a point count where the player wants to stay or where the count exceeds "21" and the player has broken or busted. When the total point value of a hand exceeds "21" it is said to bust or break. The player loses the wager when the player hand busts. Therefore, busting or breaking is a catastrophic termination of play of the player.

A second option is not to have the player hand augmented by any additional cards (referred to as a "stand"). The player may elect stand at any time that the player hand has not busted, including with the initial two-card hand dealt to the player at the beginning of the game.

A third option, referred to as doubling down, permits the player to double the wager and receive one additional card. For example, if the player has a point count where no card dealt to the player would cause the hand to break, and the dealer displays a weak card (e.g., 2, 3, 4, 5 or 6) as the expose card, the player may double the initial wager and limit hits to a single card. This is ordinarily done when the player's initial count in the first two cards are 9, 10 or 11.

A fourth option is available when the player's initial hand is comprised of two cards that are a pair or of the same point count (e.g., such as a pair of nines, or each of the two cards has a value of '10', a 10 and a jack, or a pair of queens, for example). The player may split the pair into first and second player hands. An additional card is dealt to the first player hand (which is then played as a regular hand, with similar options as described above being available in the play of the first split hand). After play has been concluded with the first split hand, a card is dealt to the second split card to form the second player hand. The second split hand is then played to conclusion in the manner of a regular Blackjack hand or Twenty-One hand. In most casinos, the player is given the added opportunity of creating even more hands by splitting if either or both of the second two cards dealt to the player also has the same number count as the split pair of cards. There is normally a limit of 3 or 4 total hands that may be created by splitting cards, however, the number of splits possible may be any amount desired by the house. There may also be rules that aces can be split only once and that aces may receive only a single card (no subsequent hits) when aces are split from the initial hand.

The decision to hit or stand is made with an objective of causing the player total point value to be closer to "21" than the dealer total point value without busting. It should be understood that central factors in making the decision are the dealer's face-up card and the player's two-card total point value.

After all of the players stand the dealer's face-down card is turned face-up, whereby both cards of the dealer hand are face-up. When the dealer's total point value is less than "17," the dealer must hit until the dealer total point value is at least "17." When a hit causes the dealer hand to bust and the player hand has not busted, the player wins the wager. A 'soft' 17, (where a player's ace counted as 11 contributes to the point total of 17), may be hit again at the option of house rules. It should be understood that when the dealer's initial hand includes an ace and a six, for example, it is referred to as a soft "17" because the ace causes the exemplary hand to have alternative point values of "7" and "17". Usually, the dealer hand cannot be hit when it is the soft "17".

When neither the player hand nor the dealer hand busts and the dealer total point value exceeds the player total point value, the dealer wins and vice versa. When there is a push, there is no winner; the initial wagers representative of the bets are returned to the player. This describes the essentially standard method of play of the game of Blackjack or Twenty-One. As with any form of entertainment, variations, extensions or improvements of the game are often attempted or described.

U.S. Pat. No. 5,615,888 (Lofink) discloses the game known as "Spanish 21"™ blackjack in which all 10's are removed from the deck, (leaving only 48 cards, including all Jacks, Queens and kings) in the deck, and the payout on Blackjacks may be adjusted.

U.S. Pat. No. 7,080,839 (Shackleford) describes a method and computer readable storage medium to play an improved variation of blackjack. The method includes (a) receiving an original wager for the blackjack game; (b) dealing a player's hand and a dealer's hand; (c) finishing the game; and (d) if the player's hand ties the dealer's hand then the player wins a payout from the original wager.

U.S. Pat. No. 6,776,416 (Jackson) discloses a wagering game is played with one or more standard decks of playing cards. Each deck comprises a) 52 cards or b) 48 cards without 10's. The method comprises: each player placing at least one wager to play in the game against a dealer; each player receiving two initial cards and the dealer receiving two initial cards; each player exercising optional rights to take additional cards, (hits) until the player stands with a point count of 21 or below, or each player exercising optional rights to take additional cards until a point count in a player's hand exceeds a point count of 21, the player's hand remaining in-play even after a point count in excess of 21 is obtained; and the dealer taking hits according to conventional rules of blackjack so that the dealer total count according to the rules reaches at least a soft 17, at least a hard 17, or a count in excess of 21; wherein, if both the player's hand and the dealer's hand exceed a point count total in excess of 21, rules determine whether the player's hand wins, ties or loses against the dealer's hand. Hands of 21 or under always wins over a bust hand. In ties of point counts of 21 and/or below, either convention rules or special rules determine whether the dealer wins or ties the player's hand. In addition, the player may receive in excess of 3:2 for a blackjack.

SUMMARY OF THE INVENTION

A blackjack game is played with either multiple modified playing card decks or with at least one set of 10-value playing cards in the decks treated as non-point cards so that an additional card must be given to the player or dealer with the no-point card. Standard blackjack payouts (3:2) are changed to 1:1 payouts except for a matched suited blackjack which is paid 2:1. Also, a suited pair of 10-count cards is paid 3:2 on the initial wager. In most other respects, the game (referred to herein as "Slapjack 21"™ game is similar to blackjack.

DETAILED DESCRIPTION OF THE INVENTION

A modified deck of forty-eight (48) playing cards is provided, with only twelve (12) 10-value cards. The twelve (12), rather than the normal sixteen (16) may be provided in any manner. One manner would be by using only three different ranks (i.e., three of the four ranks of 10's, Jacks, Queens and Kings) with cards of each of each suit (spades, hearts, diamonds and clubs) as 10-value cards. The other rank may be removed or a standard deck may also be used, with four (4) of the 10-value cards identified as 0-value or Null cards (this is referred to as a "converted deck"), which 0-value cards, when received by a player or dealer, will require replacement (e.g., an additional card) at some point during the game when a 0-value card is received. The use of 0-value cards will effectively convert a standard deck to forty-eight cards, with an additional four same suited 0-value cards. The game will first be described with a modified 48-card deck, and the parallel and additional play with a converted deck will be discussed after the first description.

The Modified Deck—A modified deck of playing cards used in the game will have forty-eight active cards in play. The forty-eight cards will comprise or consist of four cards with one each in the four seats of values Ace, two, three, four, five, six, seven, eight and nine. The modified deck will also have twelve (12) 10-value cards, three cards in each of the suits. The rank and play of each of the same suited, same 10-rank cards are treated equally. In a preferred embodiment, all 10-value cards are the same image of rank (e.g., all Jacks, all 10's, all Queens, or all Kings). Play will be described with all 10-value cards being Jacks (three of each suit), but it should be remembered that if other 10-value ranks are present to make the count of twelve 10-value cards, image of the rank, that is differentiating between tens, Jacks, Queens and Kings is waived, as explained in greater detail.

Play with the Modified Deck—A player makes an underlying wager in the game of Blackjack or Twenty-One, the dealer dealing with at least one and preferably multiple (2, 3, 4, 5, 6, 7, 8 or more decks) modified decks of playing cards. Side bets, as known in the art or as provided within the practice of the present technology may also be made at the start of the game or at available points in the play of the game. The dealer deals two cards to each player (preferably both face-up, but they may be dealt one or more face-down) and two cards to the dealer, one card face-up. Blackjacks of cards from two suits (two non-matching suits) are paid, preferably at only 1:1 (although they may be paid at 3:2). Blackjacks of a single suit (the Ace and the 10-value card are the same suit) are paid at 2:1. Twenty counts formed by two 10-value cards of a single suit (referred to as TwinJacks, e.g., two Jacks of Spades or a Jack of Spades and King of spades in a converted deck) are treated as a winning hand, even against a dealer's blackjack or a dealer's TwinJack (which is treated as a standard 2-count hand).

After the first two player cards and dealer cards are evaluated, the game of SlapJack 21™ blackjack proceeds as would a normal blackjack game. Players and dealers take hits or stand according to house rules. A preferred rule for the dealer is that a dealer must hit on a soft 17, but the house may require the dealer to stay with a soft 17. Common rules of play, such as splitting pairs (possibly other than a TwinJack), surrender, double downs and the like will be played in normal fashion in the SlapJack 21™ blackjack game.

Side Bets or Bonuses in SlapJack 21™ Blackjack Game

Standard or known side bets may be used in SlapJack 21™ blackjack games, such as side bets on consecutive numbers of blackjacks, Over-Under 13™ game, Three-Card Poker 21+3 side bet, and the like. In addition, the following types of side bets and bonuses that tend to focus on SlapJack 21™ blackjack game may be used.

a) Player's TwinJack will be paid 3:2
b) Player's Flush Blackjack (same suited blackjack) will be paid 2:1
c) Player's non-flush blackjack will be paid 1:1
d) House Optional Rule—Player's Flush Blackjack or player's TwinJack may push with a dealer's blackjack or dealer's flush blackjack
e) Bonus (no side bet wager) when there is a three-card flush with player's initial two cards and dealer's up-card, or special bonus when player's initial two cards and the dealer's up card are three matched (same suited) jacks (or three suited 10-value cards with a modified deck).
f) Bonus (no side bet wager) when there is a three-card flush with player's initial two cards and dealer's up-card, or special bonus when player's initial two cards and the dealer's up card total 21 same suited with 2 jacks and an Ace. (or two 10-value cards and an Ace with a modified deck).
g) Bonus payment (no side bet) for player flush hands of exactly 21 final count with 3 or more cards paid 2:1 on initial wager
h) Bonus payment (no side bet) for player flush hands of exactly 17-20 final count with 3 or more cards that beat the dealer's hand paid 3:2
i) Bonus payment (no side wager) for player hands that tie dealer final count with player flush hands of exactly 17-20 final count with 3 or more cards paid 0.5× (½) the initial wager
j) Player hands that bust with a flush card that forms a TwinJack lose only half their initial wager
k) When doubling down (with only two cards when doubling down), the initial bet is paid 2:1 on three card flush hand with 21 count and paid 1:1 on the double bet or may be paid 2 to 1 as a bonus on 21-count flush hand formed from initial two-card hand from split. Double down may be limited to hands of 10 and 11
l) Double down hands with three-card flush and counts between 17 and 20 that beat the dealer are paid 3 to 2 inclusive that tie the dealer final count may be paid 0.5 (½) the bet on that hand (initial or from split)
m) 10-value cards (e.g., especially Jacks in SlapJack 21™ game where only Jacks are present) may be split only once, and players may double down any bet on the split 10-value cards
n) Blackjack payouts on split 10-value cards are those of a first initial two-card hand in SlapJack 21™
o) Three-Card Hard Hand™ side bet (described later, herein)
p) Match the Color™ side bet (described later, herein)
q) Double Bet Bonus side bet (described later, herein)

Three-Card Hard Hand (TCHH)

It is important to note that this is not a poker game. A side bet must be placed on the game, in addition to the blackjack wager TCHH is played using the player's two-card hand is dealt face-up and one dealer's card is face-up. This wager will likely be settled immediately, rather than waiting until the blackjack game is completed. The player is paid on the TCHH wager, by way of a non-limiting example, as follows:

1:1 on a three card total up-card count between 17 and 20.
2:1 on a three-card total up-card count of exactly 21.
25:1 on a three-card total up-card count with three same-suited hands of exactly 21.

Match the Color™ (MTC) Side Bet in SlapJack 21™ Blackjack Game

It is important to note that this is not intended to be a poker game. A side bet must be placed or may be placed on the TCHH game as well as the MTC, in addition to the blackjack wager. The player's two-card hand is dealt face-up and one dealer's card is face-up. This wager will likely be settled immediately, rather than waiting until the blackjack game is completed. The player is paid on the MTC wager as follows:

A Three-card color match among the player's two initial cards and the dealer's up-card pays 3:2 (that is all three cards are RED or all three cards are Black)
A Three-card identical suit match (may be limited to total counts between 17 and 21) pays 7:1, for example.

Double Bet Bonus

If a player wagers on both side bets. player's hand that form a 21 flush with the player's 2 cards and the dealer's up card will win a bonus of at least 5:1 paid on the lowest wager of the 2 bets These and other aspects of the technology of SlapJack 21™ blackjack game are described in the claims and in the following examples. These concepts are intended to be generic in scope, and only limitations recited in the claims should be used to determine the limits of the claims, except for defined terms in the specification.

EXAMPLE 1

With Modified Deck

A game with two players and a single house dealer will be described for convenience. Player 1 and Player 2 make $10 blackjack (SlapJack 21™ game) wagers and $5 TCHH wagers and are dealer cards as follows, with other optional games or wagers not shown in this example:

| Player 1 | Player 2 | Dealer |
|---|---|---|
| 7♣4♣ | J♥J♥ | J♣ (up-card) A♦ (Down-card) |

The first resolution of wagers before completing the underlying blackjack (SlapJack 21™ game) game would be as follows, depending upon house rules:

Player 1 would be paid as follows:

25:1 (25×$5=$125) on the TCHH hand because of the 3-card twenty-one count on the player's first two cards and the dealer's Jack up-card that are same-suited. Player 1 loses the blackjack (SlapJack 21™ game) play wager because of the dealer's blackjack.

Player 2 would be paid as follows:

Player 2 is paid 3:2 on the TwinJack hand and under certain house rules, the TwinJack hand beats the dealer's blackjack, Player 2 loses the TCHH wager, as three Jacks is not a hand on which payments are received.

EXAMPLE 1

With Converted Deck

A game with two players and a single house dealer will be described for convenience.

Player 1 and Player 2 make $10 blackjack (SlapJack 21™ game) wagers and $5 TCHH wagers and are dealt cards as follows:

| Player 1 | Player 2 | Dealer |
|---|---|---|
| 7♣4♣ | J♥K♥ | Q♣ (up-card) A♦ (Down-card) |

The first resolution of wagers before completing the underlying blackjack game would be as follows, depending upon house rules:

Player 1 would be paid as follows:

25:1 (25×$5=$125) on the TCHH hand because of the 3-card twenty-one count on the player's first two cards and the dealer's Queen up-card that are same suited. Player 1 loses the blackjack (SlapJack 21™ game) play wager because of the dealer's blackjack.

Player 2 would be paid as follows:

Player 2 is paid 3:2 (1.5×$10=$15) on the TwinJack hand (as all 10-value cards, except for one 0-value equivalent (here selected as the 10 s) and under certain house rules, the TwinJack hand beats the dealer's blackjack. Player 2 loses the TCHH wager, as a 30-count hand (J-Q-K out of suit) is not a hand on which payments are received.

One description of methods of play of the present technology is provided as a method of playing a wagering game of at least one player hand against a dealer hand with playing card symbols using blackjack RULES of play. At least one player makes a first wager on an underlying playing card symbol game from a set of playing card symbols. symbols has one of more sets of card symbols with each set having exactly thirty-six cards of count values between 1 and 9 and only twelve cards of count values of ten, suits among all cards are evenly distributed. The player is dealt exactly an initial 2-card hand. The dealer being dealt exactly an initial 2-card hand, only one dealer card dealt face-up. The player is always paid on the first wager for at least the following events, payment made before completion of blackjack play:

i) 3:2 on same suited counts of 20 using only count cards of 10-value in the player's hand;
ii) 1:1 on non-suited player blackjack hands;
iii) 2:1 on suited player blackjack hands;
iv) at least 1:1 bonus on a same-suited 21-count (two 10 value cards and an Ace) using the dealer's up-card and the player's initial 2-card hand.
v) at least 2:1 bonus on a same suited 30-count (three 10 value cards) using the dealer's up-card and the player's initial 2-card hand.
vi) Player's flush count of 21 with 3 or more cards will win a payout of 2:1
vii) Player's flush count of 17 to 20 with 3 or more cards that beats the dealer's hand will wins a payout of 3:2
viii) Player's flush count of 17 to 20 with 3 or more card that tie the dealer's hand will wins a payout of at least 1:2
ix) All payout and bonuses may be higher or lower.

A second and alternative description of a game according to this technology may be: a method of playing a wagering game of at least one player hand against a dealer hand with playing card symbols using blackjack rule of play wherein:

a) at least one player makes a first wager on an underlying playing card symbol game from a set of playing card symbols;
b) the set of playing card symbols have one of more sets of card symbols with each set having exactly thirty-six cards of count values between 1 and 9 and only twelve cards of count values of ten, suits among all cards are evenly distributed;
c) the player is dealt exactly an initial 2-card hand;
d) the dealer is dealt exactly an initial 2-card hand, only one dealer card dealt face-up;
e) the player always is paid on the first wager for at least the following events, payment made before completion of blackjack play:
   i) 3:2 on same suited counts of 20 using only count cards of 10-value in the player's hand;
   ii) 1:1 on non-suited player blackjack hands;
   iii) 2:1 on suited player blackjack hands;
   iv) at least 1:1 bonus on a same-suited 21-count (two 10 value cards and an Ace) using the dealer's up-card and the player's initial 2-card hand.
   v) at least 2:1 bonus on a same suited 30-count (three 10 value cards) using the dealer's up-card and the player's initial 2-card hand.
   vi) Player's flush count of 21 with 3 or more cards will win a payout of 2:1
   vii) Player's flush count of 17 to 20 with 3 or more cards that beats the dealer's hand will wins a payout of 3:2
   viii) Player's flush count of 17 to 20 with 3 or more card that tie the dealer's hand will wins a payout of at least 1:2
   ix) All payout and bonuses may be higher or lower
   x) Side wager bet based on the players initial 2 cards and the dealer's up card wherein the Player makes additional wager that the 3 card combination will be from 17 to 21 wherein 17 to 20 pays 1:1 but may be higher or lower 21 pays 1:1 to 2:1; and 21 flush pays from 15:1 to 30 to 1.

The play is preferred when physical playing cards are dealt to the player and to the dealer. Otherwise, a processor randomly selects playing card symbols and sends signals to at least one monitor to display the player's initial two card hands and the dealer's up-card so that player's can see this displayed data.

In the method, when a player's hand of same suited counts of 20 uses only count cards of 10-value in the player's hand, that hand may have a higher rank than a blackjack hand for a dealer or ties a dealer blackjack. Preferably all twelve 10-value playing cards consist of exactly cards consisting of 10's, Jacks, Queens and Kings. More preferably all twelve 10-value playing cards consist of exactly cards consisting of only one of 10's, Jacks, Queens and Kings. Still more preferably all twelve 10-value playing cards consist of exactly cards consisting of ranks of 10's, Jacks, Queens and Kings, with four cards of each rank and all four cards of one of the ranks has a count of 0.

The game may also be played as an electronic or internet game, such as by a video gaming apparatus comprising a processor, video screen and player input controls. The processor executes software enabling play of the game of SlapJack 21™ game as a wagering game and displaying virtual cards in the play of the game on the video screen.

Gaming tables are often provided with large (Rule sheets) or small (rack sheets) descriptions of play and variations in play of the games. Below is a possible broad (with alternatives) Rule sheet for use with a game within the disclosed parameters of a SlapJack 21™ game.

SlapJack 21 game is dealt and played as a standard Blackjack game except for the rules below. SlapJack 21 game is a same-suited-based blackjack game.

SlapJack 21™ game is preferably played with a 48 card deck with 4 suits: Diamonds, Hearts, Clubs and Spades Contents of deck: 4 Aces 1 of each suit, 4 Twos 1 of each suit, 4 Threes 1 of each suit, 4 Fours 1 of each suit, 4 Fives 1 of each suit, 4 Sixes 1 of each suit, 4 Sevens 1 of each suit, 4 Eights 1 of each suit, 4 Nines 1 of each suit and 12 (single rank, e.g., 10, J, Q or k) Jacks with 3 Jacks of each suit.

Preferably Played with 6 or 8 Decks—Dealer Hits on Soft 17

Dealer's First 2 Card Hand

Dealer's Blackjack wins against all hands—except for player's TwinJacks (two jacks of the same suit), a Same-Suited Blackjack and a Blackjack. Dealer's TwinJacks play as a 20 count.

Player's First 2 Dealt Cards

Player's TwinJacks will be paid 3 to 2. Player may win a higher payout with the dealer's card. Player's Flush Blackjack will be paid 2 to 1. Player may win a higher payout with the dealer's card. Player's Non-Flush Blackjacks will be paid 1 to 1

Dealer's Bonus

A bonus is paid out on the player's first 2 cards and the dealer's up card with a 3 card flush combination of 21 (Ace and 2 Jacks of the same suit) or 3 Jacks of the same suit. No extra wager is made. Rule does not apply to split hands.

Ace and TwinJack of the same suit will be paid a 1:1 bonus over the winning payment for beating the dealer.

TripleJacks of the same suit will be paid a 2:1 bonus over the winning payment for beating the dealer.

Flush Hands all Cards in Hand Must Consist of Same Suit

All player's flush counts of 21 will be paid 2 to 1.

All player's same-suited flush counts of 17 to 20 that beats the dealer's hand with three or more cards will be paid 3 to 2.

Tie Hands

Player with a flush count from 17 to 20, that tie the dealer's hand with 3 or more cards, will win ties with a payout of ½ the wager. Player without a flush count from 17 to 21, that tie the dealer's hand will be a push.

Doubling Down with 2 Cards Only (Double Down on 10 & 11 Only)

Players that Double Down and have a three card flush count of 21 will be paid 2 to 1 on the play bet and 1 to 1 or 2 to 1 (house option) on the Double Down bet. Players that Double Down and have a three card flush count from 17 to 20 that beats the dealer's hand will be paid 3 to 2 on the play bet, and 1 to 1 or 3 to 2 (house option) on the Double Down Players with a flush count from 17 to 20, that tie the dealer's hand, will win ties with a payout of ½ the wager and a push or 1 to 2 (house option) on the Double Down bet. All other player's double down hands that beats the dealer's hand will be paid 1 to 1.

Splitting Pairs

Split hands (2 to 9) are played as an individual hand and may be split up to 4 hands. Rules and payouts in the game of SlapJack 21 apply on split hands.

Rules for Split Aces: Aces may be split to 2 hands only and will receive 1 card for each Ace only. Player's that are dealt a Flush Blackjack are paid 2 to 1.

Non-Same-Suited Blackjacks are played as a 21.

All other counts are played as is.

Rules for Split Jacks: Jacks may be split to 2 hands only Player's that are dealt a Flush Blackjack are paid 2 to 1. Player's that are dealt TwinJacks are paid 3 to 2.

Player's that are dealt a Non-Same-Suited Blackjacks, the hand will be played as a 21.

Player's that are deal Non-Flush Jacks, the hand will be played as a 20. All other flush rules and payouts apply.

Side Bet

Three Card Hard Hand: Rules are on the next page.

Match the Color: Rules are on the next page.

Double Bet Bonus: Rules are on the next page.

The invention claimed is:

1. A video gaming apparatus comprising a processor, video screen and player input controls, the processor executing software enabling play of a virtual playing card wagering game and displaying virtual cards in the play of the game on the video screen, wherein the virtual playing card wagering game is played at virtual player positions and a virtual dealer position with steps of:

a) at least one player virtual position being provided with a first wager on an underlying playing card symbol game from a set of physical playing;

b) providing a virtual set of physical playing cards, the virtual playing card symbols having one of more sets of card symbols with each set having exactly thirty-six cards of count values between 1 and 9 and only twelve cards of count values of ten;

c) the virtual player position being dealt exactly an initial random 2-card hand from the set of virtual playing cards;

d) the dealer position hand being dealt exactly an initial random 2-card hand from the virtual set of playing cards, with only one dealer position hand card dealt face-up;

e) the virtual player position always being considered for and paid for on the first wager for at least the following events, payment made before completion of blackjack play:

xi) 3:2 on same suited counts of 20 using only count cards of 10-value in the virtual player position's hand;

xii) 1:1 on non-suited virtual player position blackjack hands;

xiii) 2:1 on suited virtual player position blackjack hands;

xiv) at least 1:1 bonus on a same-suited 21-count consisting of two 10 value cards and an Ace using the virtual dealer position's up-card and the virtual player position's initial 2-card hand;

xv) at least 2:1 bonus on a same suited 30-count with three 0 value physical playing cards using the virtual dealer position's up-card and the virtual player position's initial 2-card hand;

xvi) virtual player position's flush count of 21 with 3 or more cards win a payout of 2:1;

xvii) virtual player position's flush count of 17 to 20 with 3 or more cards that beats the virtual dealer position's hand wins a payout of 3:2;

xviii) virtual player position's flush count of 17 to 20 with 3 or more card that tie the virtual dealer position's hand wins a payout of at least 1:2;

f) a virtual player position receiving a first side wager before step c) bet based on the virtual player position's initial 2 cards and the virtual dealer position's up card where the first side bet wager is a wager that the 3 card combination will be from 17 to 21: wherein 17 to 20 pays at least 1:1; 21 pays 1:1 to 2:1; and 21 flush pays from 15:1 to 30 to 1; and/or a virtual player position receiving a second separate side wager bet before step c) based on the players 2 initial cards and the virtual dealer's up card, the second separate side bet wager requiring that the player position receives a payout when the 3 card combination will be all the same color or a flush, with 3 cards same color paying multiple odds; and a 3 card flush pays multiple odds; and g) when a virtual player position receives wagers on both side bets, that virtual player's position hand that forms a 21 flush with the player's position 2 cards and the virtual dealer position's up card will win a bonus of at least 5:1 paid on the lowest wager of the 2 bets.

2. A video gaming apparatus comprising a processor, video screen and player input controls according to claim 1 wherein exactly two cards are dealt to the player position and to the dealer position from the randomized set of playing cards and both side bets in f) are received at a single player position, such that any player's position hand that form a 21 flush with the player's position 2 cards and the dealer position's up card will win a bonus of at least 5:1 paid on the lowest wager of the 2 bets.

3. A video gaming apparatus comprising a processor, video screen and player input controls of claim 1, wherein all twelve 10-value virtual playing cards consist of exactly cards consisting of only one of 10's, Jacks, Queens and Kings.

4. A video gaming apparatus comprising a processor, video screen and player input controls according to claim 1, the processor executing software enabling display of all twelve 10-value virtual playing cards that consist of exactly images of cards consisting of only one of 10's, Jacks, Queens and Kings.

* * * * *